US009618959B2

(12) United States Patent
Ambundo et al.

(10) Patent No.: US 9,618,959 B2
(45) Date of Patent: Apr. 11, 2017

(54) REFERENCE GENERATOR CIRCUIT WITH DYNAMICALLY TRACKING THRESHOLD

(71) Applicant: TEXAS INSTRUMENTS INCORPORATED, Dallas, TX (US)

(72) Inventors: Alushulla Jack Ambundo, Plano, TX (US); Jim Le, Fairview, TX (US)

(73) Assignee: Texas Instruments Incorporated, Dallas, TX (US)

( * ) Notice: Subject to any disclaimer, the term of this patent is extended or adjusted under 35 U.S.C. 154(b) by 194 days.

(21) Appl. No.: 14/483,335

(22) Filed: Sep. 11, 2014

(65) Prior Publication Data

US 2015/0069992 A1 Mar. 12, 2015

Related U.S. Application Data

(60) Provisional application No. 61/877,193, filed on Sep. 12, 2013.

(51) Int. Cl.
*G05F 5/00* (2006.01)
*G05F 1/46* (2006.01)

(52) U.S. Cl.
CPC . *G05F 5/00* (2013.01); *G05F 1/46* (2013.01)

(58) Field of Classification Search
CPC ... G05F 3/30; G05F 3/26; G05F 3/262; G05F 3/265; G05F 3/267; G05F 1/575; G05F 5/00; G05F 1/46
USPC ..... 323/312–317, 280–281; 327/77, 80, 79, 327/81, 83
See application file for complete search history.

(56) References Cited

U.S. PATENT DOCUMENTS 4,375,037 A * 2/1983 Ikushima ..... H04B 10/695 327/166
5,923,211 A * 7/1999 Maley ..... G05F 1/46 323/313
6,040,720 A * 3/2000 Kosiec ..... G05F 3/245 327/513
7,821,321 B2 * 10/2010 Zimlich ..... G05F 3/30 323/315
2007/0194768 A1 * 8/2007 Bansal ..... G05F 1/573 323/277

* cited by examiner

*Primary Examiner* — Jessica Han
*Assistant Examiner* — Bart Iliya
(74) *Attorney, Agent, or Firm* — Lawrence J. Bassuk; Charles A. Brill; Frank D. Cimino

(57) ABSTRACT

A circuit includes a reference circuit configured to receive a reference input voltage and provides a first output signal that is a function of the reference input voltage. The circuit includes a reference adjuster configured to receive an external input signal and generates a second output signal that is a function of the external input signal to control an offset voltage to adjust the first output signal. The first output signal and the second output signal are combined to provide a dynamic reference output signal. If the external input signal has crossed a predetermined threshold, the dynamic reference output signal tracks the external input signal while maintaining a substantially constant voltage difference relative to the external input signal.

19 Claims, 2 Drawing Sheets

REFERENCE GENERATOR CIRCUIT WITH DYNAMICALLY TRACKING THRESHOLD

CROSS-REFERENCE TO RELATED APPLICATION

This application claims the benefit of U.S. Provisional Patent Application 61/877,193 filed on Sep. 12, 2013, and entitled REFERENCE BUFFER WITH DYNAMICALLY TRACKING THRESHOLD, the entirety of which is incorporated by reference herein.

TECHNICAL FIELD

This disclosure relates to electrical circuits, and more particularly to a reference generator circuit that employs a dynamically tracking threshold.

BACKGROUND

Comparator circuits can be employed as general purpose input buffers to provide signal conditioning for an input signal with respect to a fixed reference voltage at the comparator. Such input buffers can suffer differing problems depending on the application. For high noise environments, inputs are often times clamped hard to provide a wide noise margin. Such clamping schemes however can provide large voltage differences between the input node of the comparator and its respective reference input which can unfortunately cause the transition time of the buffer to suffer. For instance, for a general purpose input buffer, the reaction time of the buffer can be severely degraded due to slow transition times at the input. In particular, the portion of the transition edge between the initial state of an input signal and the input threshold crossing set by the reference signal is essentially wasted. Unfortunately, this period of time can vary significantly due to both internal and external factors such as: supply voltage levels, input clamping levels, input slew rate, input VOL/VOH levels, and so forth.

SUMMARY

This disclosure relates to a reference generator circuit that employs a dynamically tracking threshold.

In one example, a circuit includes a reference circuit configured to receive a reference input voltage and provides a first output signal that is a function of the reference input voltage. The circuit includes a reference adjuster configured to receive an external input signal and to generate a second output signal that is a function of the external input signal to control an offset voltage to adjust the first output signal. The first output signal and the second output signal are combined to provide a dynamic reference output signal. If the external input signal has crossed a predetermined threshold, the dynamic reference output signal tracks the external input signal while maintaining a substantially constant voltage difference relative to the external input signal.

In another example, a circuit includes a reference circuit configured to receive a reference input voltage and to provide a first output signal that is a function of the reference input voltage. A reference adjuster is configured to receive an external input signal and to generate a second output signal that is a function of the external input signal to control an offset voltage to adjust the first output signal. The first output signal and the second output signal are combined to provide a dynamic reference output signal. The dynamic reference output signal is substantially equal to the external input signal plus the offset voltage, as to track the external input signal, if the external input signal is less the reference input voltage minus the offset voltage. The dynamic reference signal is substantially equal to the reference input voltage if the external input signal is greater than the reference input voltage minus the offset voltage.

In yet another example, an integrated circuit includes a reference circuit that includes a first error amplifier and a regulation circuit to provide a first output signal that is a function of the reference input voltage. The first error amplifier has a feedback path that follows the reference input voltage to generate a first error signal that drives the regulation circuit to provide the first output signal. A reference adjuster includes a second error amplifier and an offset circuit. The reference adjuster receives an external input signal and generates a second output signal that is a function of the external input signal. The second error amplifier has a feedback path that follows the external input voltage to generate a second error signal. The second error signal drives the offset circuit to generate an offset voltage to adjust the first output signal. The first output signal and the second output signal are combined to provide a dynamic reference output signal. The dynamic reference output signal tracks the external input signal depending on the external input signal relative to a predetermined threshold while maintaining a substantially constant voltage difference relative to the external input signal. A comparator receives the dynamic reference output signal at a reference input of the comparator and receives the external input signal at a signal input of the comparator. The comparator provides an output signal based on the external input signal relative to a threshold set by the dynamic reference output signal.

DETAILED DESCRIPTION

This disclosure relates to a reference generator circuit that provides a dynamic reference. The dynamic reference can provide a dynamically tracking threshold for a comparator such as to mitigate propagation delays through the circuit. For example, the circuit can include a comparator having a reference input and another input for an external input signal. The circuit includes a dynamic reference generator to generate a dynamic reference signal that is applied to the reference input of the comparator to enable dynamic adjustment of the reference and to more closely track the voltage level of the input signal. By dynamically adjusting the voltage level of the reference closer to the voltage level of the input signal transition, faster switching speeds can be achieved through the circuit since the input signal transition reaches the signal crossing threshold faster. After the transition, a substantially constant difference is maintained by the dynamic reference generator between the input signal and the dynamic reference signal to provide suitable noise margins.

Figure 1:
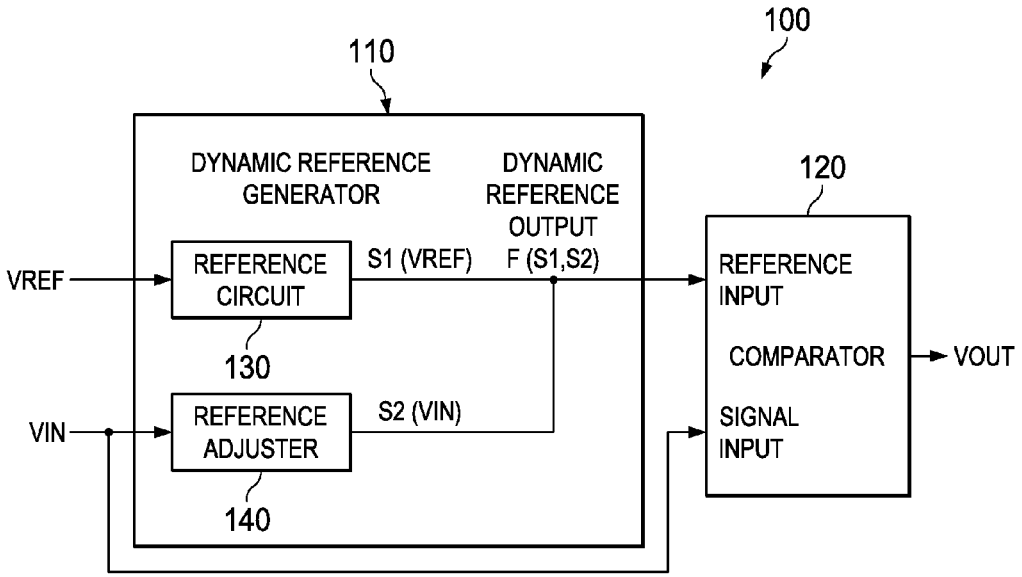
FIG. 1 illustrates an example of a reference generator circuit having a dynamically tracking threshold.

FIG. 1 illustrates an example of a circuit 100 having a dynamically tracking threshold to enable faster signal transitions though the circuit. As used herein, the term "circuit" can include a collection of active and/or passive elements that perform a circuit function such as an amplifier or comparator, for example. The term circuit can also include an integrated circuit where all the circuit elements are fabricated on a common substrate, for example. The circuit 100 includes a dynamic reference generator 110 to generate a dynamic reference output signal that is applied to an input of a comparator 120. The comparator 120 receives an external input signal VIN and generates an output signal VOUT in response to VIN and the dynamic reference. When the input signal VIN crosses a threshold set by the dynamic reference output signal, VOUT transitions in response to VIN crossing the threshold. For example, if VIN is low and transitions high, when VIN crosses the threshold set by the dynamic reference output signal, VOUT will switch high after the transition. Similarly. When VIN transitions below the threshold set by the dynamic reference output signal, VOUT will transition low after the transition. In one example, the circuit 100 provides signal conditioning or buffering for the input signal VIN such that VOUT can drive subsequent circuits after the conditioning (e.g., VOUT applied to a serial repeater bus). The operation of the comparator 120 can be reversed by connecting the input signals to different inputs.

The dynamic reference generator 110 is configured to generate the dynamic reference output signal to enable dynamic adjustment of the comparator reference input as to more closely track the voltage level of the input signal VIN. By dynamically moving the voltage level of the reference input of the comparator 120 closer to the voltage level of the VIN input signal transition, faster switching speeds can be achieved through the circuit 100 since the input signal transition reaches the signal crossing threshold of the comparator 120 faster. After the transition, a substantially constant difference is maintained by the dynamic reference generator between the input signal and the dynamic reference output signal to provide suitable noise margins for the comparator 120.

The dynamic reference generator 110 can include a reference circuit 130 and a reference adjuster 140 that cooperate in the analog domain to provide the dynamic reference output signal. As shown, the reference circuit 130 provides a first output signal (S1) that is a function of a fixed reference input voltage VREF. The reference adjuster 140 receives the external input signal VIN and generates a second output signal (S2) that is a function of the external input signal. As will be illustrated and described below with respect to FIGS. 2 and 3, the reference adjuster 140 controls an offset voltage to adjust the first output signal S1. The first output signal S1 and the second output signal S2 are combined to provide the dynamic reference output signal which varies as a function of both S1 and S2. If the external input signal VIN has crossed a predetermined threshold set by the cooperative effects of the reference circuit 130 and the reference adjuster 140 (e.g., corresponding to a difference between VREF and the offset voltage controlled by the reference adjuster), the dynamic reference output signal then tracks the external input signal VIN while maintaining a substantially constant voltage difference relative to the external input signal.

As a further example, the functional relationship between S1 and S2 to provide the dynamic reference output signal can be stated as: If VIN>VREF minus an offset voltage (generated in the reference adjuster), then the dynamic reference output signal voltage is substantially equal to VREF. If VIN<VREF minus the offset voltage, then the dynamic reference output signal voltage is substantially equal to VIN plus the offset voltage. In this manner, the dynamic reference generator 110 dynamically adjusts the reference level applied to the comparator 120 reference input relative to the external signal VIN. From a DC perspective, the reference levels remain the same, but after the external signal has crossed a predetermined threshold set by the reference adjuster 140, the dynamic reference output signal should start to follow the external signal VIN while maintaining a substantially constant difference relative to the external signal for noise margin.

By limiting the bandwidth of the dynamic reference (See e.g., delay circuit in FIG. 3), the external signal VIN can change and cross the dynamic threshold well before the dynamic reference output signal can react. This enables the comparator 120 to react much sooner than it would have been able to if the reference level was static as in conventional buffer circuits. In other approaches, extra power is used and/or parasitics are reduced to improve the buffer response time in conventional circuits. However, there is a fundamental limit to the improvement offered by this approach due to the uncertainty of the input VIN. In contrast to such approaches, the circuit 100 disclosed herein allows the reference VREF to be a dynamic function of the input VIN and hence the uncertainty impact of the input VIN is substantially reduced.

Figure 2:
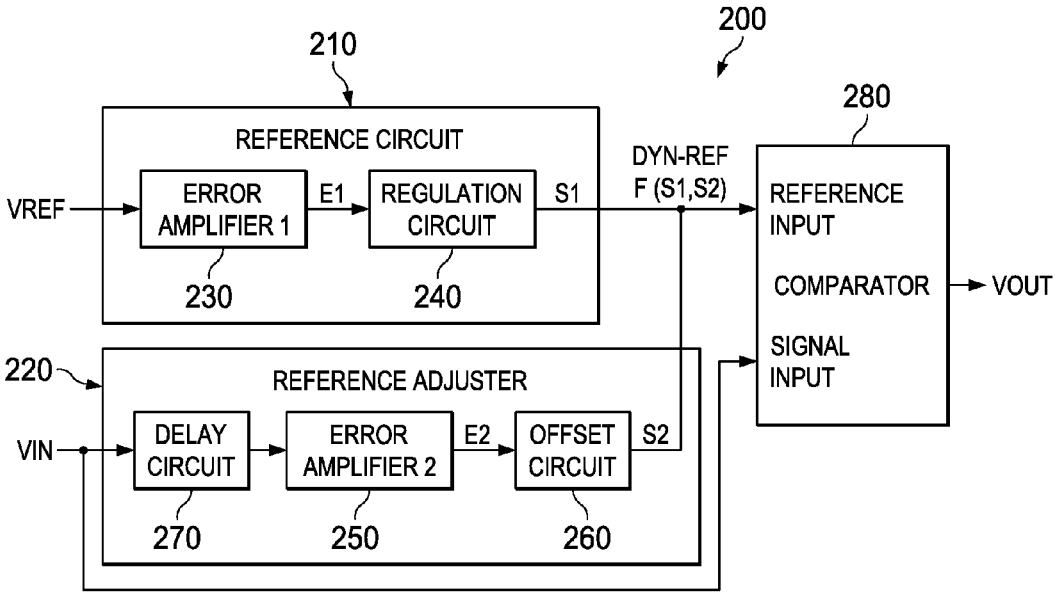
FIG. 2 illustrates an example of a circuit having a reference circuit and reference adjuster to provide a dynamically tracking threshold.

FIG. 2 illustrates an example of a circuit 200 having a reference circuit 210 and reference adjuster 220 to provide a dynamically tracking threshold to enable faster signal transitions though the circuit. The circuit 200 can correspond to the circuit 100 disclosed in the example of FIG. 1. In one example, the circuit 200 can be provided as an integrated circuit formed on a substrate, for example. The reference circuit 210 includes a first error amplifier 230 and a regulation circuit 240 to provide a first output signal S1 that is a function of a reference input voltage VREF. The first error amplifier 230 has a feedback path (See e.g., FIG. 3) that follows the reference input voltage VREF to generate a first error signal E1 that drives the regulation circuit 240 to provide the first output signal S1. The regulation circuit 240 can include a cooperative pair of transistor devices to facilitate adjustment of the first output signal S1.

The reference adjuster 220 includes a second error amplifier 250 and an offset circuit 260. The reference adjuster 220 receives an external input signal VIN and generates a second output signal S2 that is a function of the external input signal VIN. A delay circuit 270 can be provided to limit the bandwidth of VIN as applied to the reference adjuster 220 in order to mitigate threshold crossings at the transition of VIN with respect the dynamic thresholds described herein. The second error amplifier 250 has a feedback path that follows the external input voltage VIN to generate a second error signal E2. The second error signal E2 drives the offset circuit 260 to generate an offset voltage to adjust the first output signal S1 and, in turn, provide a dynamic reference DYN–REF as a function of both S1 and S2.

If the external input signal VIN has crossed a predetermined threshold (e.g., corresponding to a difference between VREF and the offset voltage controlled by the offset circuit 260), the dynamic reference output signal DYN–REF tracks the external input signal while maintaining a substantially constant voltage difference relative to the external input signal. A comparator 280 receives the dynamic reference output signal DYN–REF at a reference input of the comparator and receives the external input signal VIN at a signal input of the comparator. The comparator 280 changes its output signal when the external input signal crosses a threshold set by the dynamic reference output signal DYN–REF.

Figure 3:
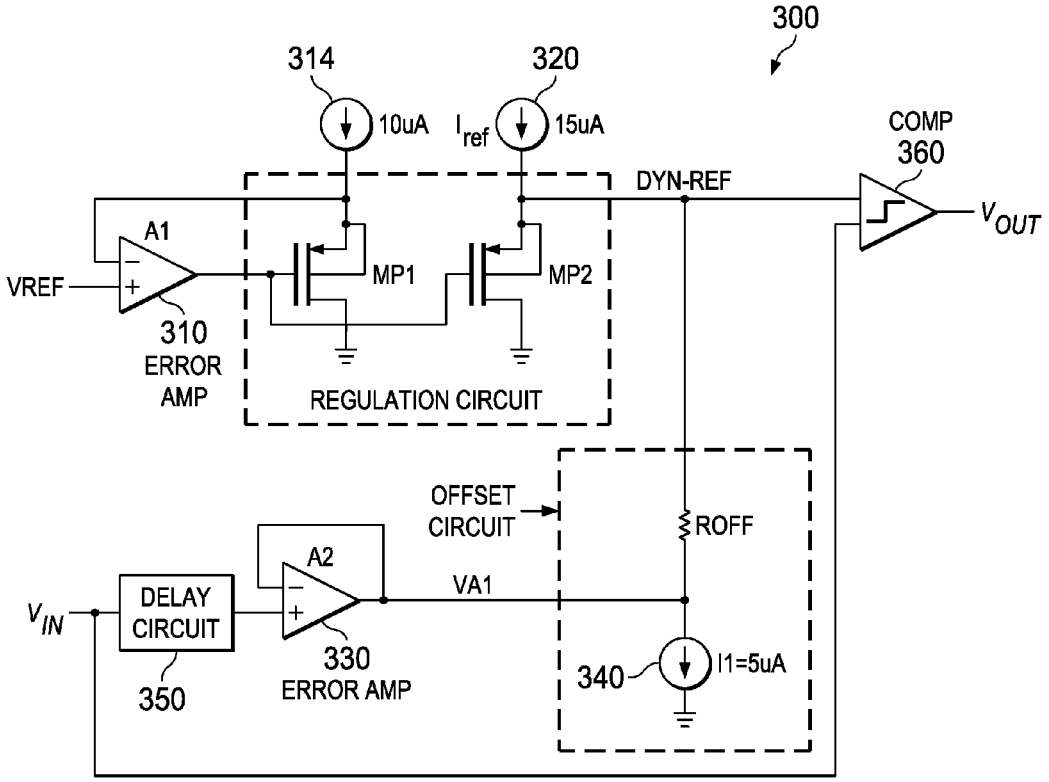
FIG. 3 illustrates an example of an error amplifier circuit having multiple feedback loops to provide a dynamically tracking threshold.

FIG. 3 illustrates an example of an error amplifier circuit 300 having multiple feedback loops to provide a dynamically tracking threshold to enable faster signal transitions through the circuit. The circuit 300 can correspond to the dynamic reference generator 110 of FIG. 1, for example. A static DC reference level is set in the circuit via first error amplifier 310. The amplifier 310 regulates a source of transistor switch device MP1 (e.g., source follower) to a level of VREF. The transistor source follower MP1 receives current from current source 314 (e.g., about 10 uA). A second source follower MP2 can be biased with the same gate voltage as MP1 and matched such that, with similar bias currents, the source of MP2 should replicate VREF. As shown, MP2 receives a reference current from current source 320. The second source follower can act as a current sink to sink current from current source 320.

A second amplifier stage having a second error amplifier 330 has unidirectional current drive and can only regulate (e.g., sink current) if VIN is less than the VREF–VOFFSET. A current source I1 at 340 (e.g., about 5 uA) defines a minimum VOFFSET level, where VOFFSET is defined as a current flowing through offset resistor ROFF. Output of the amplifier 330 utilizes a feedback loop to adjust its output shown as VA1 with respect to the input signal VIN. Bandwidth at the input of amplifier 330 is limited by a delay circuit 350 (e.g., RC filter) which delays the response relative to VIN and facilitates that the reference input (positive terminal of amplifier 330) settles slower than worst case VIN transient to mitigate multiple threshold crossings. As shown, an output from the offset circuit (e.g., the offset voltage across ROFF) is combined with the output at MP2 to provide a dynamic reference output signal DYN–REF to a reference input of a comparator 360.

By way of example, if VIN>VREF, the amplifier 330 feedback holds the output device off (in amplifier 330 and not shown) where VA1=VREF–I1*ROFF and under this condition, current through MP2 is similar (e.g., substantially identical) to the current through MP1, causing DYN–REF to equal VREF. When VIN<VREF–I1*ROFF, the amplifier 330 feedback turns on its output device and thus, amplifier 330 starts pulling additional current through ROFFSET. This additional current is steered (e.g., directed) away from MP2 such that DYN–REF starts to follow VIN plus an offset defined by the current through ROFFSET. When IREF at 320 is completely steered through ROFF, MP2 is turned off and DYN–REF follows VIN with maximum offset VOFFSET=IREF*ROFF. When VIN rises again, the delay circuit 350 prevents amplifier 330 from responding immediately and thus DYN–REF is set to a minimum input voltage VIN,MIN+VOFFSET, where VIN,MIN is a value of VIN that is below a threshold to turn on amplifier 330. After the delay, the amplifier 330 responds and starts to turn off its respective output device. Current IREF at 320 is then steered back toward MP2, which being biased at VREF–VGS1 of MP1, turns on and causes DYN–REF from rising above VREF.

Figure 4:
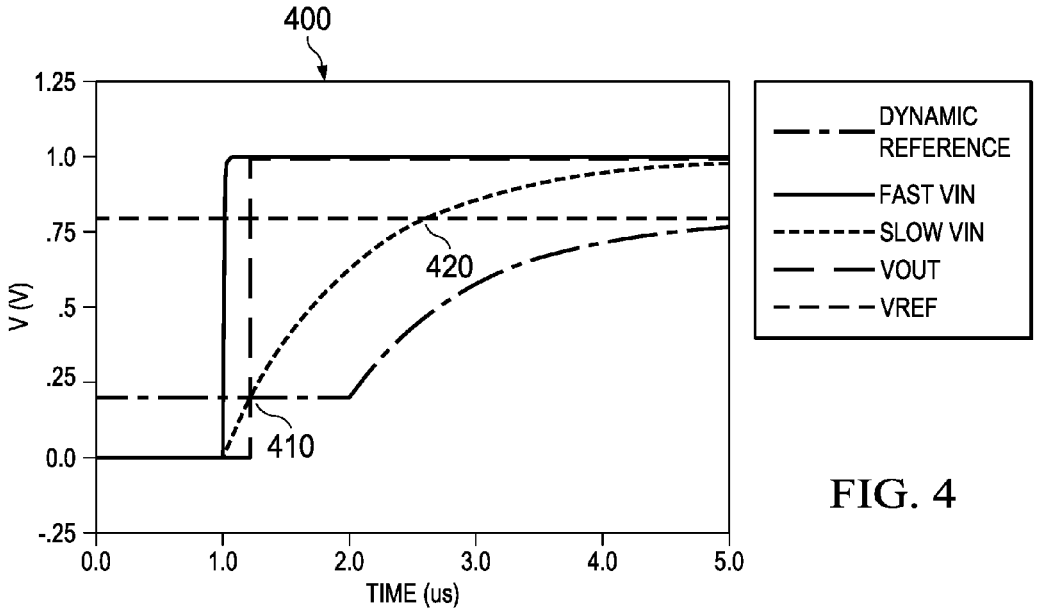
FIG. 4 illustrates an example signal diagram illustrating signal transitions with respect to a dynamically tracking threshold.

FIG. 4 illustrates an example signal diagram 400 illustrating signal transitions with respect to a dynamically tracking threshold. A fast input signal transition applied to a comparator and dynamic reference generator as described herein is shown as FAST VIN. The FAST VIN signal typically does not cause a significant delay through the comparator as the edge transition of the signal occurs in a rapid manner. A slow rising VIN is shown as SLOW VIN. When the SLOW VIN crosses a DYNAMIC REFERENCE shown at crossing point 410, an output signal VOUT of the comparator transitions. If the dynamic reference were not employed, the signal VOUT would not transition until it crossed the static VREF threshold (e.g., 0.8V) shown at crossing point 420. Thus, by employing the dynamic reference to dynamically adjust the level of VREF as seen by the comparator, faster switching speeds through the comparator can be achieved. As shown, the dynamic reference tracks SLOW VIN to provide a substantially constant noise margin between SLOW VIN and the dynamic reference.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. A circuit comprising:

a reference circuit having an input to receive a reference input voltage and an output to provide a first output signal that is a function of the reference input voltage;

a reference adjuster having an input to receive an external input signal and an output to generate a second output signal; and a comparator having a first input connected to a dynamic reference output signal formed by a connection of the outputs of the reference circuit and the reference adjuster, a second input connected to the external input signal, and an output.

2. The circuit of claim 1, in which the dynamic reference output signal is substantially equal to the external input signal plus the offset voltage if the external input signal is less the reference input voltage minus the offset voltage.

3. The circuit of claim 1, in which the dynamic reference signal is substantially equal to the reference input voltage if the external input signal is greater than the reference input voltage minus the offset voltage.

4. The circuit of claim 1, the reference circuit including a first error amplifier that receives the reference input voltage and generates a first error signal that is controlled via a feedback path in the first error amplifier.

5. The circuit of claim 4, including a first transistor switch device in the feedback path having a source that is regulated by the first error signal to a voltage set based on the reference input voltage.

6. The circuit of claim 5, including a second transistor switch device that is controlled by the first error signal to provide a current sink coupled to the dynamic reference output signal.

7. The circuit of claim 6, the reference adjuster including an offset circuit to direct current from the second transistor device if the external input voltage is less than the reference input voltage minus the offset voltage generated by the offset circuit.

8. The circuit of claim 7, in which the offset circuit includes a current source that drives an offset resistor to generate the offset voltage.

9. The circuit of claim 8, the reference adjuster including a second error amplifier having a unidirectional output and feedback path to generate a second error signal, the second error signal adjusts current flowing to the offset circuit to control the offset voltage in response a voltage level set by the external reference input signal.

10. The circuit of claim 9, including a delay circuit configured to delay a response of the second error amplifier with respect to transitions of the external input signal to mitigate multiple threshold crossings of the second error amplifier.

11. A circuit comprising:

a reference circuit having an input to receive a reference input voltage and an output to provide a first output signal that is a function of the reference input voltage; and a reference adjuster having an input to receive an external input signal and an output to generate a second output signal that is a function of the external input signal to control an offset voltage to adjust the first output signal, in which the first output signal and the second output signal are combined to provide a dynamic reference output signal, the dynamic reference output signal being substantially equal to the external input signal plus the offset voltage, if the external input signal is less the reference input voltage minus the offset voltage, the dynamic reference output signal being substantially equal to the reference input voltage if the external input signal is greater than the reference input voltage minus the offset voltage.

12. The circuit of claim 11, in which if the external input signal has crossed a predetermined threshold, the dynamic reference output signal tracks the external input signal while maintaining a substantially constant voltage difference relative to the external input signal.

13. The circuit of claim 12, the reference circuit including a first error amplifier that receives the reference input voltage and generates a first error signal that is controlled via a feedback path in the first error amplifier.

14. The circuit of claim 13, including a first transistor switch device in the feedback path having a source that is regulated by the first error signal to a voltage set based on the reference input voltage.

15. The circuit of claim 14, including a second transistor switch device that is controlled by the first error signal to provide a current sink coupled to the dynamic reference output signal.

16. The circuit of claim 15, the reference adjuster including an offset circuit to direct current from the second transistor switch device if the external input voltage is less than the reference input voltage minus the offset voltage generated by the offset circuit.

17. The circuit of claim 16, the reference adjuster including a second error amplifier having a unidirectional output and feedback path to generate a second error signal, the second error signal adjusts current flowing to the offset circuit to control the offset voltage in response a voltage level set based on the external reference input signal.

18. An integrated circuit comprising:

a reference circuit that includes a first error amplifier and a regulation circuit to provide a first output signal that is a function of the reference input voltage, the first error amplifier having a feedback path that follows the reference input voltage to generate a first error signal that drives the regulation circuit to provide the first output signal;

a reference adjuster that includes a second error amplifier and an offset circuit, the reference adjuster receives an external input signal and generates a second output signal that is a function of the external input signal, the second error amplifier having a feedback path that follows the external input voltage to generate a second error signal, the second error signal drives the offset circuit to generate an offset voltage to adjust the first output signal, in which the first output signal and the second output signal are combined to provide a dynamic reference output signal; and a comparator that receives the dynamic reference output signal at a reference input of the comparator and receives the external input signal at a signal input of the comparator, in which the comparator provides an output signal based on the external input signal relative to the dynamic reference output signal.

19. The integrated circuit of claim 18, in which the dynamic reference output signal is substantially equal to the external input signal plus the offset voltage if the external input signal is less the reference input voltage minus the offset voltage, the dynamic reference output signal being substantially equal to the reference input voltage if the external input signal is greater than the reference input voltage minus the offset voltage.

* * * * *